US008343020B2

(12) United States Patent
Castel

(10) Patent No.: US 8,343,020 B2
(45) Date of Patent: Jan. 1, 2013

(54) METHOD AND APPARATUS FOR PHYSICAL THERAPY EXERCISE

(75) Inventor: J. Chris Castel, Reno, NV (US)

(73) Assignee: ZMI Electronics, Ltd., Kaohsiung (TW)

( * ) Notice: Subject to any disclaimer, the term of this patent is extended or adjusted under 35 U.S.C. 154(b) by 55 days.

(21) Appl. No.: 13/034,305

(22) Filed: Feb. 24, 2011

(65) Prior Publication Data

US 2011/0143894 A1 Jun. 16, 2011

Related U.S. Application Data

(62) Division of application No. 11/270,374, filed on Nov. 9, 2005, now abandoned.

(51) Int. Cl.
*A63B 21/00* (2006.01)

(52) U.S. Cl. ..... 482/121; 482/126; 73/760

(58) Field of Classification Search ..... 73/760, 73/763, 788; 482/121, 125
See application file for complete search history.

(56) References Cited

U.S. PATENT DOCUMENTS

| | | | | |
|---|---|---|---|---|
| 3,822,061 | A * | 7/1974 | Sigma | 482/126 |
| 4,394,865 | A * | 7/1983 | Sidorenko et al. | 600/595 |
| 5,267,929 | A * | 12/1993 | Chen | 482/128 |
| 5,538,486 | A * | 7/1996 | France et al. | 482/8 |
| 5,853,356 | A * | 12/1998 | David | 482/126 |
| 2002/0055424 | A1 * | 5/2002 | Brown | 482/91 |
| 2005/0119591 | A1 * | 6/2005 | Vardy | 600/587 |

* cited by examiner

*Primary Examiner* — Jerome W Donnelly
(74) *Attorney, Agent, or Firm* — Stinson Morrison Hecker LLP

(57) ABSTRACT

A method for exercise, physical therapy and rehabilitation includes providing an elastic member having a tension indicator, securing one end of the elastic member, and stretching the elastic member using a part of the body until the tension indicator indicates that a predetermined tension level has been attained. Upon reaching the predetermined tension level, the elastic member is returned to its relaxed state. The tension indicator on the elastic member may be a printed image of recognizable image that distorts to another recognizable image at the predetermined tension level, a printed non-recognizable image that distorts to a recognizable pattern or image at the predetermined tension level, or an electronic indicator that provides audio and/or visual cues at the predetermined tension level.

11 Claims, 7 Drawing Sheets

METHOD AND APPARATUS FOR PHYSICAL THERAPY EXERCISE

CROSS-REFERENCE TO RELATED APPLICATIONS

This application is a divisional of U.S. patent application Ser. No. 11/270,374, filed on Nov. 9, 2005, which is incorporated herein by reference in its entirety.

STATEMENT REGARDING FEDERALLY SPONSORED RESEARCH OR DEVELOPMENT

Not applicable.

BACKGROUND OF THE INVENTION

1. Field of the Invention

The present invention relates to resistive exercise methods and devices, and more particularly to extensible members used to provide resistive exercise to muscles for physical therapy purposes.

2. Description of Related Art

Resistive exercise devices are widely used in the physical therapy and rehabilitation fields to exercise weak or damaged muscles. Often, such devices are extensible members that are grasped or placed on a part of the body, then stretched using that body part to exercise the muscles associated with moving that body part. After reaching a desired length, the user relaxes the muscles and allows the extensible member to retract to its starting position. For example, users may grasp opposite ends of an extensible member between their hands and move their hands apart, thus stretching the extensible member and exercising the muscles of their arms. When the hands are separated a desired distance, the user relaxes their arm muscles, bringing their hands together, and allowing the extensible member to return to its starting position. Several repetitions of an exercise are typically repeated in a physical therapy regimen.

However, while useful, known devices do not provide accurate feedback to the user as to the actual level of exercise being attained by stretching the device. Users can only estimate how far the extensible member is being stretched, and are left to gauge the amount of exercise simply by the resistance they feel in their muscles. Thus, especially in the case of exercising damaged muscles, users may tend to under-extend the device and not achieve the recommended resistance level for rehabilitation. Likewise, users may over-extend the device, and risk further damage to the muscles they are attempting to rehabilitate. In either case, the user does not receive the full benefit of the prescribed physical therapy Thus, it can be seen that there remains a need in the art for a method and device for exercising muscles and performing physical therapy rehabilitation that allows a user to accurately achieve a desired exercise level, avoiding the risks of under-exercising or over-extending their muscles.

BRIEF SUMMARY OF THE INVENTION

The present invention is directed to a method for exercising, rehabilitating or strengthening a user's body using an elastic member to facilitate resistive exercise. Each elastic member includes a tension indicator that provides feedback to the user when the elastic member attains a predetermined tension level, thus allowing the user to accurately and positively determine when a particular tension level is attained. The tension indicator may be indicia on one or more surfaces of the elastic member, providing visual feedback to the user as to the tension of the elastic member, or may be an electronic indicator, providing audio and/or visual cues to the user when a predetermined tension level is attained.

In a first exemplary embodiment, the indicia may comprise a recognizable pattern or shape that distorts or changes to a different pattern or shape when a predetermined tension level is achieved in the elastic member. For example, a square shape visible on the elastic member in its relaxed state may be distorted and appear as a rectangle when the elastic member attains a predetermined tension.

In a second exemplary embodiment, the indicia appear as an unrecognizable image when the elastic member is in its relaxed state, but form a recognizable image or pattern when the elastic member attains a predetermined level of tension. Preferably, the images or patterns are pointillist, halftone, or moiré patterns, which appear as indeterminate images or patterns when the elastic member is in its relaxed state, and appear as recognizable images or patterns when the elastic member attains a predetermined level of tension.

In a third exemplary embodiment, the tension indicator is an electronic indicator. The electronic indicator employs a strain gauge or pressure transducer to detect the level of tension being applied to the elastic member. The strain gauge or pressure transducer in turn provides a signal to circuitry in the electronic indicator to provide audio and/or visual cues to the user when a predetermined level of tension is attained. Audio cues are preferably tones or beeps, and visual cues are preferably provided through light-emitting diodes.

In a first exemplary method of the present invention, a user is provided with an elastic member having a tension indicator as in any of the embodiments described above. A first portion of the elastic member is secured in a first fixed position, and a second portion of the elastic member is engaged with a part of the user's body. With the first portion of the elastic member secured in a first position, the user then moves the engaged part of the body away from the first position, applying tension to the elastic member. The user continues to move the engaged part of the body away from the first position while simultaneously monitoring the tension indicator. When the tension indicator provides an indication that the predetermined tension level has been attained, for example via visual image, pattern, light, or audio cues as described above, the user is alerted that the desired tension level has been reached, and moves the engaged body part back toward the first position, releasing the tension in the elastic member.

In a second exemplary method of the present invention, a user is provided with an elastic member having a tension indicator. A first portion of the elastic member is engaged with a first part of the user's body, and a second portion of the elastic member is engaged with a second part of the user's body. The user then moves the first part of the body away from the second part of the body, and simultaneously moves the second part of the body away from the first part of the body. Thus, the user moves two parts of the body simultaneously to attain tension in the elastic member. When the tension in the elastic member attains a predetermined level, the tension indicator provides a visual or audio cue to the user, as described above. Thus, the user can ascertain that the predetermined tension level has been attained, and moves the two body parts back towards each other, releasing the tension in the elastic member.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

BRIEF DESCRIPTION OF THE DRAWINGS

The present invention will be described in greater detail in the following detailed description of the invention with reference to the accompanying drawings that form a part hereof, in which.

DETAILED DESCRIPTION OF EXEMPLARY EMBODIMENTS

The present invention is directed to a method for exercising, rehabilitating or strengthening a part of a user's body using an elastic member to facilitate resistive exercise, and to the elastic member used in said method. The elastic member includes a tension indicator to indicate to the user when a predetermined level of tension is attained in the member. The tension indicator may be indicia on the surface of the elastic member, or may be an electronic indicator having audio and/or visual indicators. The indicia may be initially recognizable images or patterns that distort to other recognizable patterns when a predetermined level of tension is attained, or may be initially unrecognizable images or patterns that distort to recognizable images or patterns when a predetermined level of tension is attained. The images or patterns may be pointillist images, halftone images, or moiré patterns.

Figure 1:
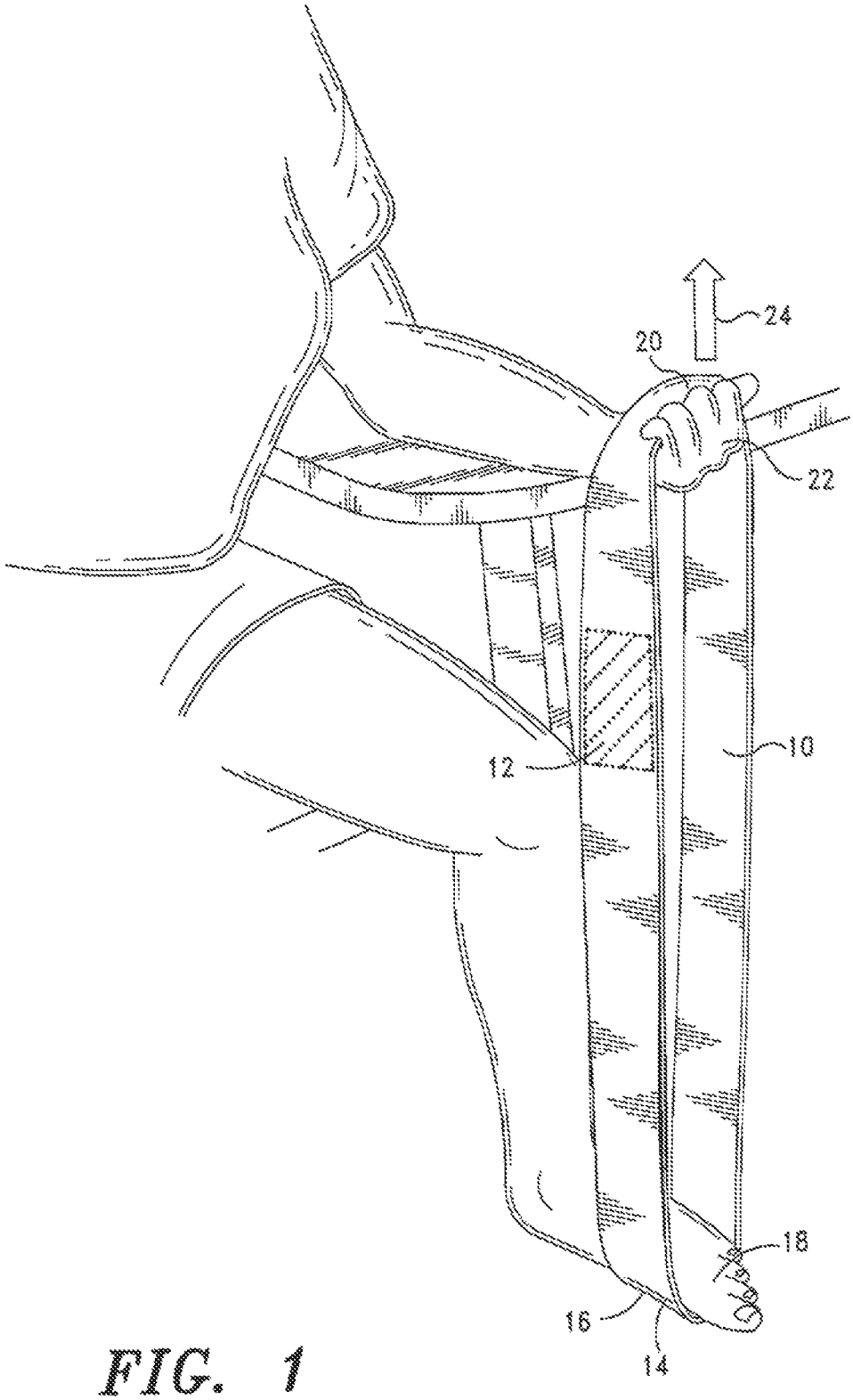
FIG. 1 is a perspective view of a user using an elastic member in accordance with a first exemplary method of the present invention, moving one portion of the elastic member away from a fixed location while monitoring a tension indicator on the member.

In a first exemplary method shown in FIG. 1, an elastic member 10 having a tension indicator 12 is provided to the user. The user secures a first portion 14 of elastic member 10 in a first position 16 under the foot 18 of the user. The user engages a second portion 20 of elastic member 10 with a hand 22 of the user's body. As indicated by the arrow 24, the user then moves the engaged hand 22 upwardly, away from first position 16, thus applying tension to elastic member 10. The user continues to move the engaged hand 22 away from first position 16 while simultaneously monitoring tension indicator 12. When tension indicator 12 indicates that a predetermined tension level has been attained in elastic member 10, the user moves the engaged hand 22 back toward first position 16, releasing the tension in elastic member 10. Repetitions of this exercise regimen are repeated as desired by the user to obtain the desired level of exercise or rehabilitation.

Variations of the exemplary elastic member facilitating various ways to secure and engage the member will be apparent to those skilled in the art, and are within the scope of the present invention. For example, the elastic member may include a handle at either or both of the first and second portions to facilitate grasping of the elastic member by the user.

Of course, it will be apparent that this method may be applied to exercise or rehabilitate any body part, and the first portion may be secured to any suitable fixed location in any manner that maintains the first portion of elastic member at the first position during use. For example, the elastic member may be engaged with any part of the body of a user, such as a limb, a head, an extremity, or a digit, to allow resistive exercise of the muscles associated with moving that body part. Where first position 16 is a part of the user's body, first portion 16 of elastic member 10 may be secured by engaging the portion with a body part, such as by grasping, tying, looping, or trapping the member to or around that body part. In the case where the stationary first position is a fixed location that is not a part of the user's body, the first portion may be secured to the first position by tying, looping, or trapping the first portion of the elastic member to or around the fixed location first position. Similarly, second portion 20 of elastic member 10 may be engaged in any manner that maintains contact between second portion 20 and the engaged part of the users body. For example, the second portion may be engaged by tying, looping, or trapping the portion with or around that body part. For instance, the first portion may be secured in a first position by tying it to a doorknob, and the second portion may be engaged with a user's foot by wrapping it around the foot. By moving the engaged foot away from the secured first position, the muscles of the user's leg will be exercised. Other variations of this method will be apparent to those skilled in the art, and are contemplated by the present invention.

Figure 2:
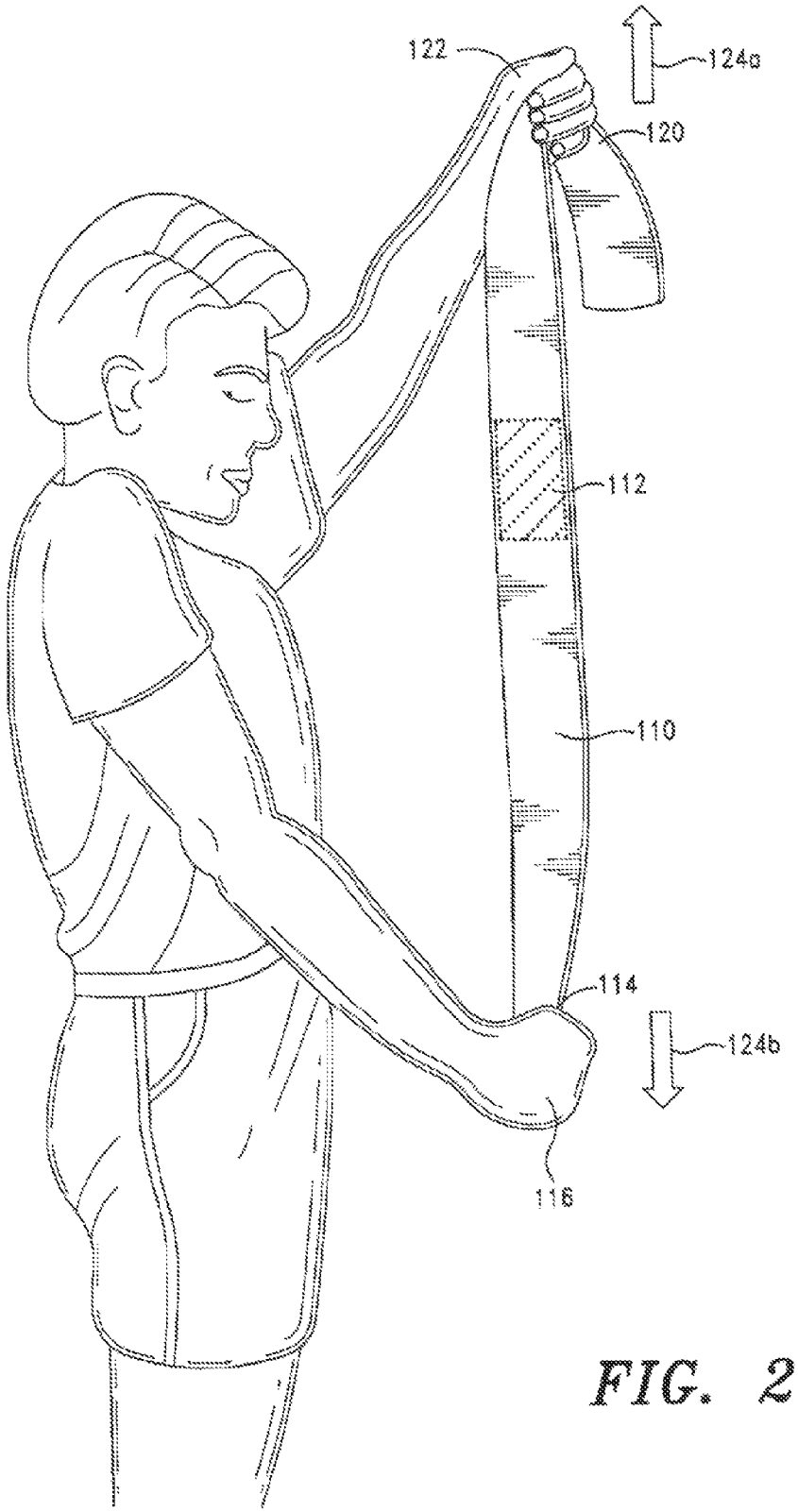
FIG. 2 is a perspective view of a user using an elastic member in accordance with a second exemplary method of the present invention, moving first and second portions of the elastic member away from each other while monitoring a tension indicator on the member.

In a second exemplary method shown in FIG. 2, an elastic member 110 having a tension indicator 112 is provided to the user. The user engages a first portion 114 of elastic member 110 with a hand 116 of the user's body by grasping first portion 114 with hand 116. The user engages a second portion 120 of elastic member 110 with a second hand 122 of the user's body. As indicated by the arrows 124A, 124B, the user then moves the upper engaged hand 122 upwardly, and simultaneously moves the lower engaged hand 116 downwardly, thus applying tension to elastic member 110. The user continues to move the hands 116, 122 away from each other while simultaneously monitoring tension indicator 112. When tension indicator 112 indicates that a predetermined tension level has been attained in elastic member 110, the user moves upper engaged hand 122 down, and/or moves lower engaged hand 116 up to release the tension in elastic member 110.

Of course, it will be apparent that this method may be applied to exercise or rehabilitate any body part. For example, the first portion may be engaged around the head of the user, and the second portion may be engaged with a user's hand. By leaning their head back and pulling their hand away from their head, the user will exercise the muscles of their neck. Other variations of this method will be apparent to those skilled in the art, and are contemplated by the present invention. Repetitions of this exercise regimen are repeated, as desired by the user to obtain the desired level of exercise or rehabilitation.

Tension Indicators

The elastic member of the present invention includes a tension indicator that provides feedback to the user, indicating when the elastic member attains a predetermined tension level. By monitoring the tension indicator, the user can accurately and positively determine when a particular tension level is attained. As described in more detail below, the tension indicator may be indicia printed on the surface of the elastic member, providing visual feedback to the user as to the tension of the elastic member, or may be an electronic indicator, providing audio and/or visual cues to the user when a predetermined tension level is attained.

Indicia

Recognizable Images

Figure 3A:
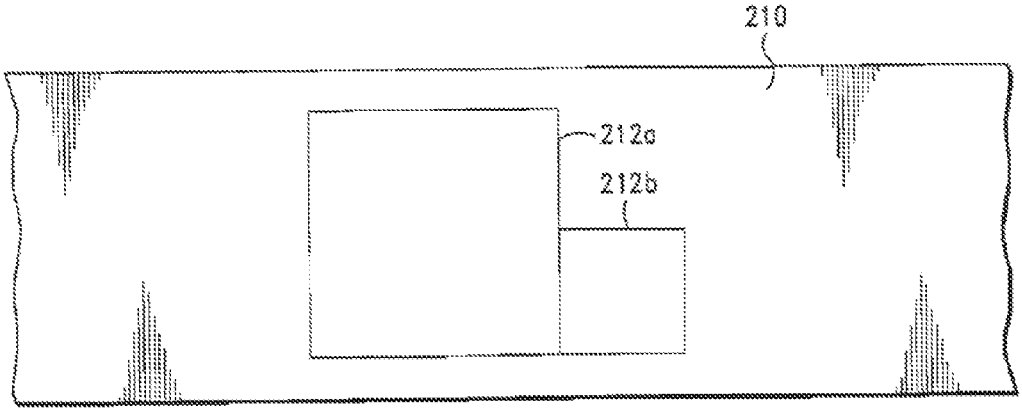
FIG. 3A is a partial plan view of an elastic member in accordance with a first exemplary embodiment of the present invention, with the elastic member in its relaxed state such that a first image is recognizable in the indicia on the surface of the elastic member.
Figure 3B:
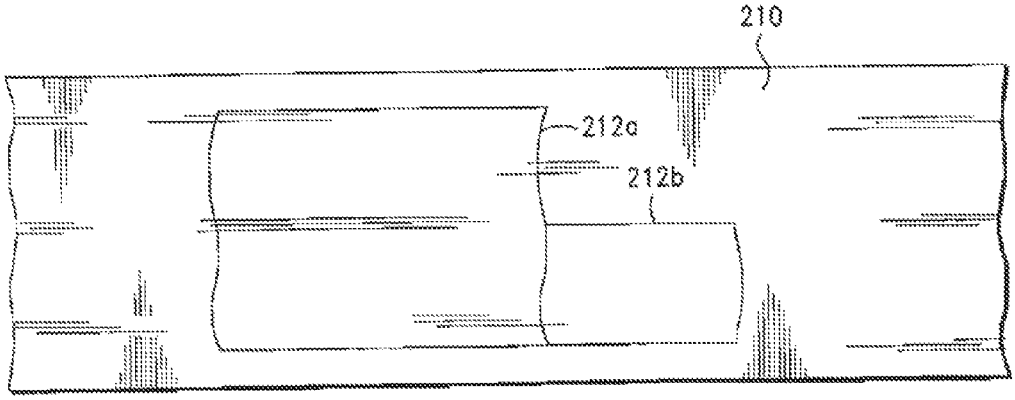
FIG. 3B is a partial plan view of the elastic member of FIG. 3A, with the elastic member in a partially extended state, such that the first image is partially distorted.
Figure 3C:
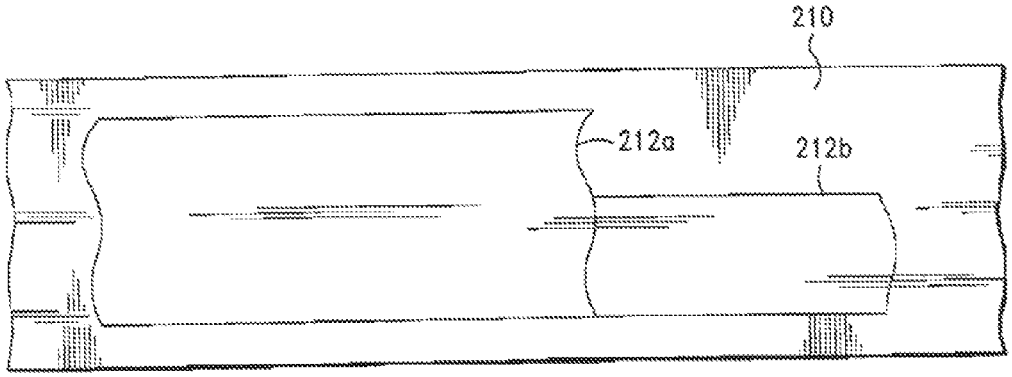
FIG. 3C is a partial plan view of the elastic member of FIG. 3A, with the elastic member extended to a predetermined tension level, so that the first recognizable image is distorted to a second recognizable image.

In a first exemplary embodiment, the printed indicia may comprise recognizable images that distort or change to different patterns when a predetermined tension level is achieved in the elastic member. For example, in the exemplary embodiment shown in FIG. 3A, side-by-side square shapes 212*a*, 212*b* are apparent and discernible when the elastic member 210 is in its relaxed state. As elastic member 210 is placed in tension, as shown in FIG. 3B, the squares 212*a*, 212*b* begin to distort. When elastic member 210 attains a predetermined level of tension as shown in FIG. 3C, the initially square shapes 212*a*, 212*b* are distorted to rectangles. A user, visually monitoring the indicia on the elastic member, perceives when the shapes have reached their rectangular shape, and ascertains that the predetermined tension level has been attained. The user then relaxes the muscles pulling elastic member 210, allowing it to return to its initial, relaxed state. Of course, while squares and rectangles are shown in FIGS. 3A, 3B, and 3C, other shapes, patterns, or images may be used without deviating from the scope of the present invention. For example, any other geometric shapes may be used, such as circles which distort to ovals. Other shapes and patterns will be apparent to those skilled in the art.

Unrecognizable Images

In a second exemplary embodiment, the printed indicia may comprise initially unrecognizable images or patterns that distort or change to a recognizable image or pattern when a predetermined tension level is achieved in the elastic member. Preferably, the images or patterns are pointillist, halftone, or moiré type, although any other type of image or pattern known in the art may also be used.

As described below in more detail, the patterns or images are printed on the elastic member when the member is stretched to a predetermined tension. When the elastic member is initially provided to the user in its relaxed state, the pattern or image is compressed, and is not discernable. When the user stretches the elastic member to the predetermined tension, the image or pattern appears, visible to the user, providing an indication that the elastic member is stretched to the predetermined tension.

Halftone Images

Halftone images are images formed from a series of dots, each dot having a gradient shade from white to black, as a grayscale. Modern halftone images may also include color dots, each dot varying in hue within a particular color. Halftone images are most well-known in the newspaper industry, where printing limitations restricted printing to individual dots varying from black to light grey. Images formed by printing a contiguous set of dots, each varying from light gray to black, appear as normal black and white picture images from a distance. On close inspection, the images can be seen to be comprised of the separate dots, and lose their continuous appearance. Thus, halftone images are visible from a distance, comprised of a series of underlying grayscale dots.

Figure 4A:
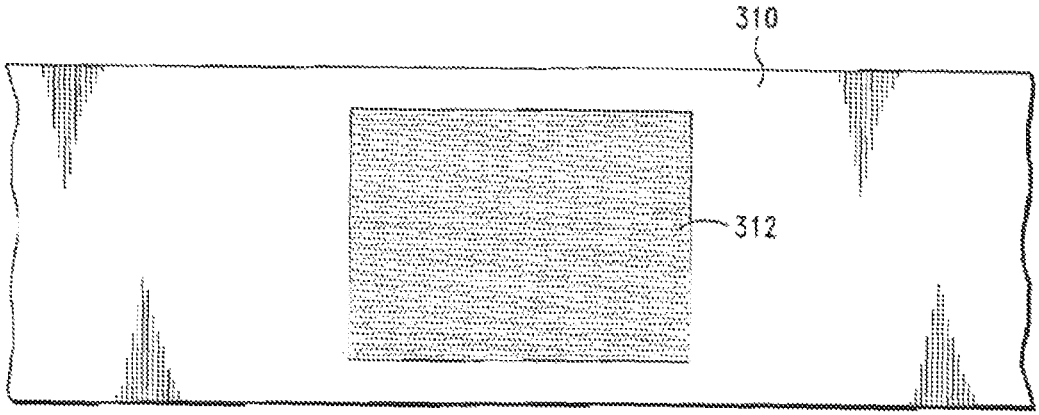
FIG. 4A is a partial plan view of an elastic member in accordance with a second exemplary embodiment of the present invention, with the elastic member in its relaxed state such that no recognizable image is discernible in the indicia on the surface of the elastic member.
Figure 4B:
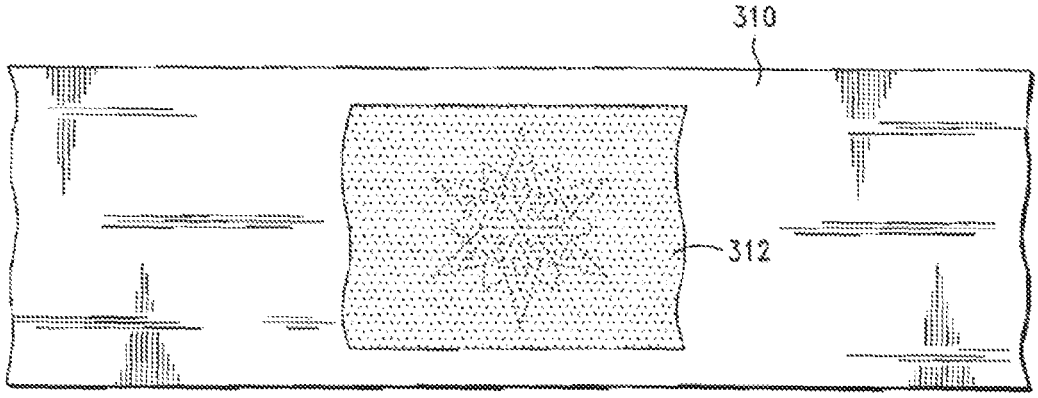
FIG. 4B is a partial plan view of the elastic member of FIG. 4A, with the elastic member in a partially extended state, with no image discernible in the indicia on the surface of the elastic member.
Figure 4C:
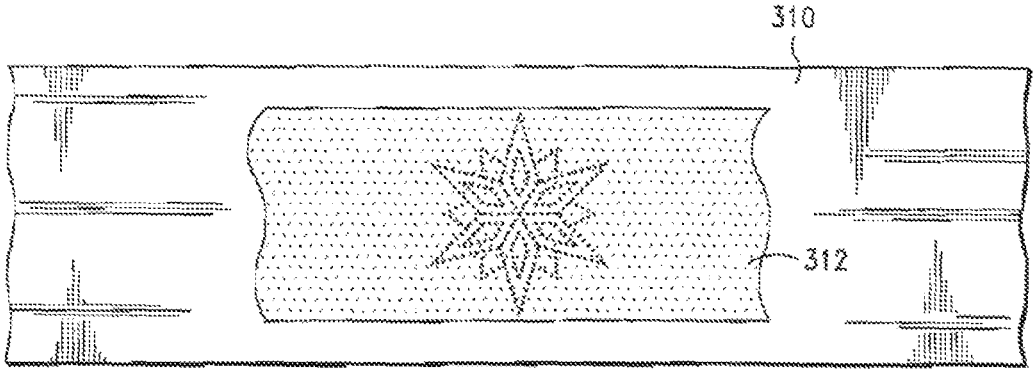
FIG. 4C is a partial plan view of the elastic member of FIG. 4A, with the elastic member extended to a predetermined tension level, so that a halftone image is recognizable in the indicia on the surface of the elastic member.

In the exemplary embodiment, depicted in FIGS. 4A, 4B, and 4C, halftone type patterns are used as indicia on the elastic member 310. When elastic member 310 is in its relaxed state, as shown in FIG. 4A, the indicia 312 form a non-recognizable image. When elastic member 310 is stretched to a predetermined tension as shown in FIG. 4C, the halftone pattern appears to the user in the distorted indicia 312. FIG. 4B depicts elastic member 310 and indicia 312 in a transitional phase between the relaxed state of FIG. 4A and the attained predetermined tension level of FIG. 4C.

Pointillist Images

Pointillist images are images formed from apparent random dots and shapes, which, when viewed from a distance in their entirety, form a recognizable image or pattern. Several examples of pointillist images are well-known in the art, such as the image of Albert Einstein formed by an arrangement of dominos. The apparent random dots and dark areas of the dominos, when viewed from a distance, form the easily recognizable likeness of the famous scientist. The pointillist images have been known since at least the late $19^{th}$ century; with pointillist paintings characterized by the application of paint in small dots and brush strokes which appear random at close view.

Figure 5A:
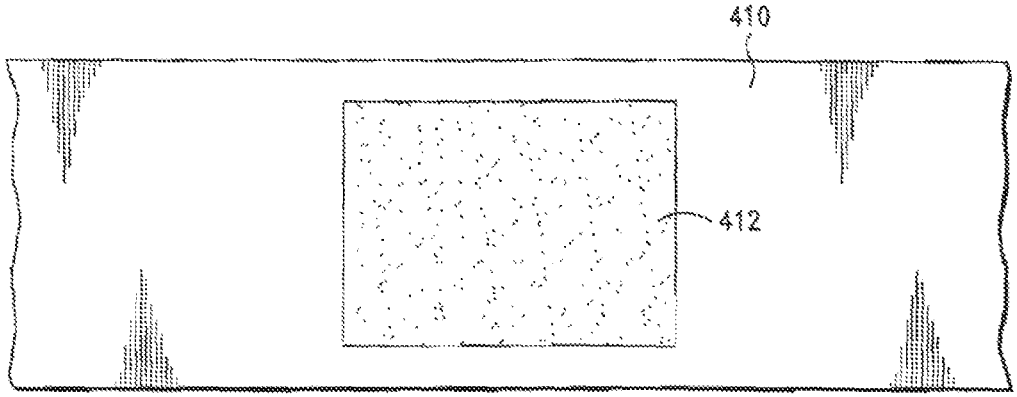
FIG. 5A is a partial plan view of an elastic member in accordance with a second exemplary embodiment of the present invention, with the elastic member in its relaxed state such that no recognizable image is discernible in the indicia on the surface of the elastic member.
Figure 5B:
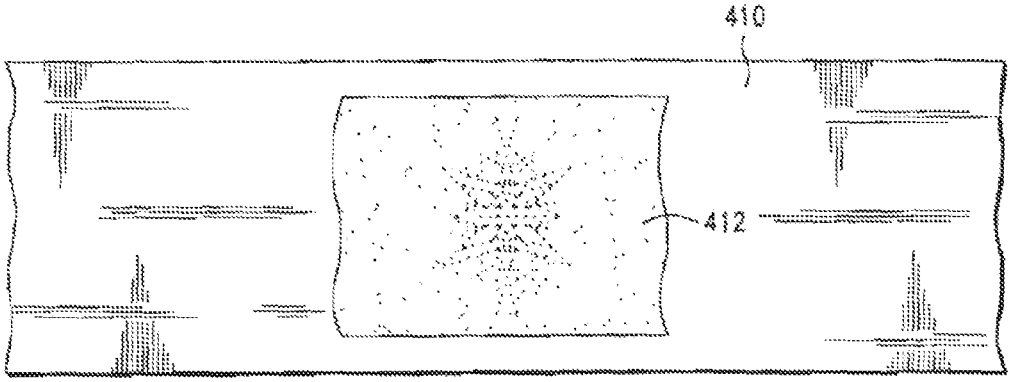
FIG. 5B is a partial plan view of the elastic member of FIG. 5A, with the elastic member in a partially extended state, with no image discernible in the indicia on the surface of the elastic member.
Figure 5C:
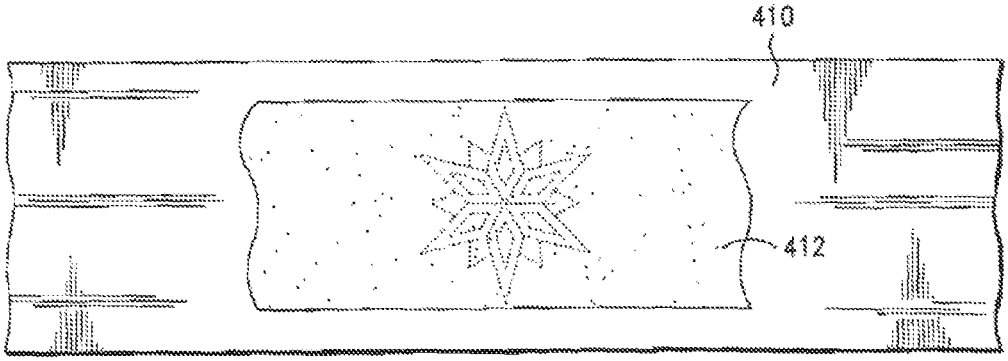
FIG. 5C is a partial plan view of the elastic member of FIG. 5A, with the elastic member extended to a predetermined tension level, so that a pointillist image is recognizable in the indicia on the surface of the elastic member.

In the exemplary embodiment depicted in FIGS. 5A, 5B, and 5C, pointillist type patterns are used as indicia on the elastic member 410. When elastic member 410 is in its relaxed state, as shown in FIG. 5A, the indicia 412 form a non-recognizable image. When elastic member 410 is stretched to a predetermined tension as shown in FIG. 5C, the pointillist pattern appears to the user in the distorted indicia 412. FIG. 5B depicts elastic member 410 and indicia 412 in a transitional phase between the relaxed state of FIG. 5A and the attained predetermined tension level of FIG. 5C.

Moiré Patterns

Moiré patterns are interference patterns perceived by the eye when viewing overlying or closely adjacent fine patterns. Moiré patterns usually appear as a series of concentric light and dark arced lines, extending radially outward from a point. Common examples of moiré patterns examples can be seen in overlying any two fine patterns, such as two fine-meshed window screens. Sliding one screen in front of the other, a viewer will see an apparent pattern of radially extending dark and light lines, shifting as the screens are moved with respect to each other.

Figure 6A:
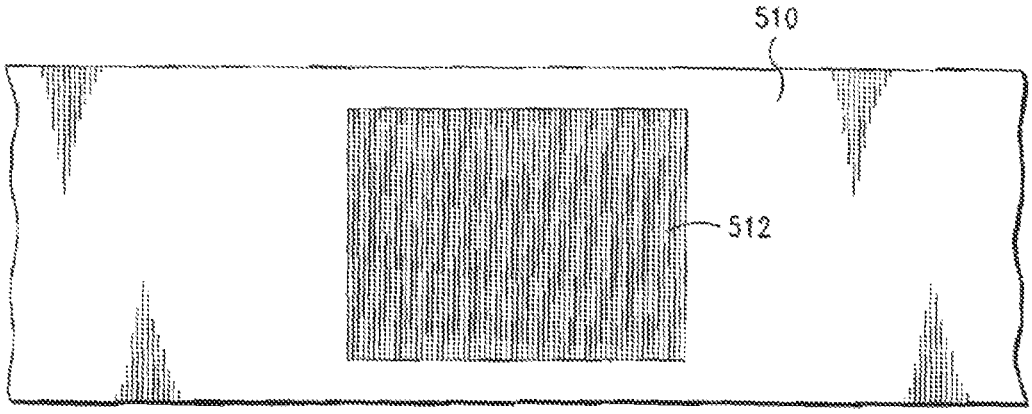
FIG. 6A is a partial plan view of an elastic member in accordance with a second exemplary embodiment of the present invention, with the elastic member in its relaxed state such that no recognizable pattern is discernible in the indicia on the surface of the elastic member.
Figure 6B:
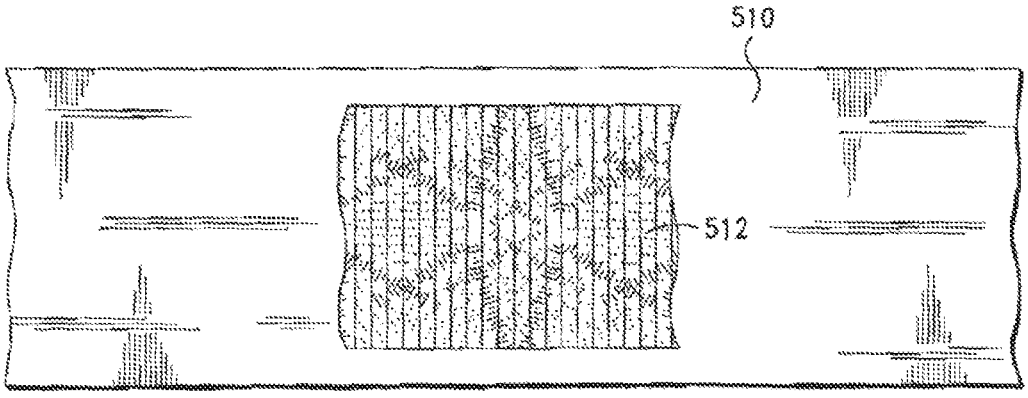
FIG. 6B is a partial plan view of the elastic, member of FIG. 6A, with the elastic member in a partially extended state, with no, pattern discernible in the indicia on the surface of the elastic member.
Figure 6C:
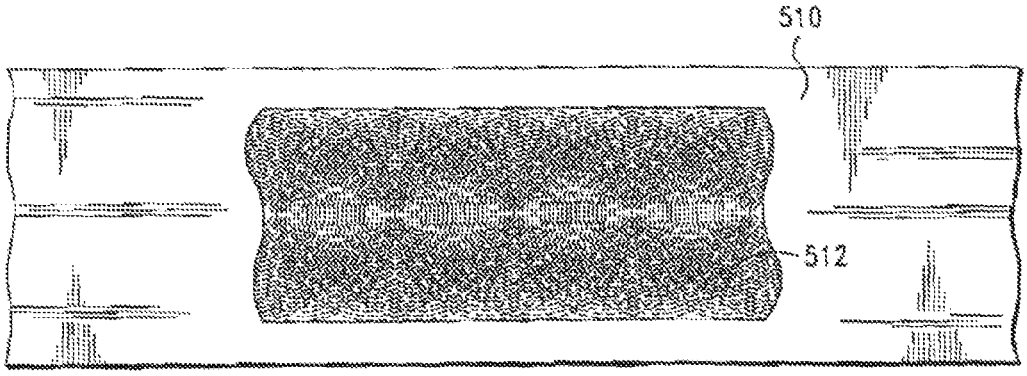
FIG. 6C is a partial plan view of the elastic member of FIG. 6A, with the elastic member extended to a predetermined tension level, so that a moiré pattern is discernible in the indicia on the surface of the elastic member.

In the exemplary embodiment depicted in FIGS. 6A, 6B, and 6C, patterns of alternating light and dark lines are printed on one or more surfaces of the elastic member 510. When elastic member 510 is in its relaxed state, as shown in FIG. 6A, the indicia 512 form a non-recognizable image. When elastic member 510 is stretched to a predetermined tension as shown in FIG. 6C, a moiré interference pattern appears to the user in the indicia 512. FIG. 6B depicts elastic member 510 and indicia 512 in a transitional phase between the relaxed state of FIG. 6A and the attained predetermined tension level of FIG. 6C.

Electronic Indicator

Figure 7:
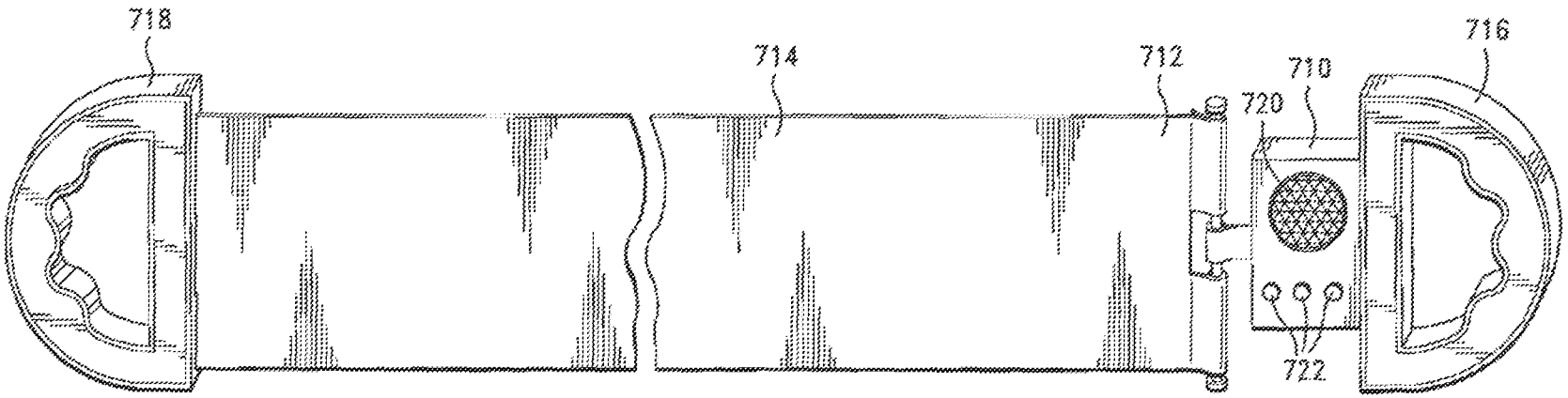
FIG. 7 is a plan view of an elastic member in accordance with a third exemplary embodiment of the present invention, having an electronic tension indicator.

Looking to FIG. 7, the tension indicator may also be an electronic indicator 710, attached between an end 712 of the elastic member 714 and a first handle 716. A second handle 718 on the opposite end of elastic member 714 allows a user to grasp and pull the apparatus. Of course, as described previously, the handle need not be grasped, but may be secured to a fixed position. Furthermore, handles are not required. The electronic indicator may be secured between two portions of the elastic member, allowing the user to engage the elastic member as described above. Electronic indicator 710 employs a strain gauge or pressure transducer to detect the level of tension being applied by the user, and provides an output signal indicating when a predetermined tension level has been attained. Circuitry in the electronic indicator provides audio and/or visual cues to the user through speaker 720 and/or light-emitting diodes (LEDs) 722 when a predetermined level of tension is attained. Of course other appropriate audio or visual cue components will be apparent to those skilled in the art, and are within the scope of the present invention. For example, the audio cue may be provided through a beeper or piezoelectric device, and the visual cue may be provided through a meter or bar-graph type display. Other devices for providing visual cues, such as alpha-numeric indicators, display screens, or counters and timers may also be used. For instance, the electronic indicator may provide a running count of performed repetitions on a numeric display, or may prompt the user through an alpha-numeric display screen or LCD panel. Preferably, the audio cues are tones or beeps, and the visual cues are provided through light-emitting components.

Elastic Member

The elastic member of the present invention may be constructed of any type of elastic material known in the art. Preferably, the elastic member is comprised of latex or non-latex rubber, and is color-coded to identify the tension properties of the member.

As shown in the following tables, elastic members made of rubber have varying tension properties, those properties depending upon the thickness and width of the member, the initial length, and the length to which the elastic member is stretched. Of course, the elastic members need not be flat, other shapes and sizes of elastic members having defined tension properties may be used without deviating from the present invention. For example, referring to the following tables, a thin, flat elastic member made of rubber having a width of six inches is color-coded yellow. For a yellow elastic member having an initial length of twelve inches, the tension in the member when the elastic member is in its relaxed, non-stretched state is, of course, zero pounds. When that same elastic member is stretched six inches, to a total length of twelve inches, the tension in the elastic member is 2.95 pounds. When stretched twelve inches, to a total length of eighteen inches, the tension in the elastic member is 4.4 pounds. Similarly, referring to the same table, a yellow elastic member having an initial length of eighteen inches in its relaxed state has a tension of zero pounds. When that elastic member is stretched to a total length of forty-two inches, the tension in the member is 4.09 pounds.

Thus, using the various color-coded thicknesses and initial lengths of available elastic members, a user may select an elastic member according to the distance the body part being exercised needs to be moved, and the tension level required, for a particular rehabilitative exercise. For example, if exercising an arm, the desired movement of the arm during exercise may only be twelve inches. If the desired tension at that distance is approximately three pounds, a user may select the twelve inch yellow member, which provides 2.86 pounds of tension when stretched twelve inches to a total length of twenty-four inches. Of course, the actual end user need not necessarily do these calculations, a health care professional, physical therapist, or exercise consultant may determine what tension and movement distance are required for a particular rehabilitative exercise, and provide the proper elastic member to the end user.

Elastic Member Properties

Properties for various typical color-coded elastic members having various initial lengths and tension properties are provided below:

| Yellow Elastic Member | | | | |
|---|---|---|---|---|
| Stretched | Initial Length (in.) | | | |
| Length (in.) | 6 | 12 | 18 | 24 |
| 6 | 0 | | | |
| 12 | 2.95 | 0 | | |
| 18 | 4.4 | 01.94 | 0 | |
| 24 | 5.37 | 2.86 | 1.54 | 0 |
| 30 | 6.51 | 3.56 | 2.33 | 1.23 |
| 36 | | 4.09 | 2.9 | 2.02 |
| 42 | | | 3.34 | 2.55 |
| 48 | | | | 2.95 |
| | Tension (lbs.) | | | |

| Red Elastic Member | | | | |
|---|---|---|---|---|
| Stretched | Initial Length (in.) | | | |
| Length (in.) | 6 | 12 | 18 | 24 |
| 6 | 0 | | | |
| 12 | 3.52 | 0 | | |
| 18 | 4.97 | 2.51 | 0 | |
| 24 | 6.42 | 3.56 | 1.8 | 0 |
| 30 | 7.39 | 4.49 | 2.95 | 1.54 |
| 36 | | 5.15 | 3.61 | 2.55 |
| 42 | | | 4.29 | 3.23 |
| 48 | | | | 3.78 |
| | | Tension (lbs.) | | |

| Green Elastic Member | | | | |
|---|---|---|---|---|
| Stretched | Initial Length (in.) | | | |
| Length (in.) | 6 | 12 | 18 | 24 |
| 6 | 0 | | | |
| 12 | 4.53 | 0 | | |
| 18 | 6.73 | 3.17 | 0 | |
| 24 | | 4.80 | 2.68 | 0 |
| 30 | | 5.94 | 4 | 1.98 |
| 36 | | 6.95 | 4.97 | 3.26 |
| 42 | | | 5.68 | 4.09 |
| 48 | | | | 4.84 |
| | | Tension (lbs.) | | |

| Blue Elastic Member | | | | |
|---|---|---|---|---|
| Stretched | Initial Length (in.) | | | |
| Length (in.) | 6 | 12 | 18 | 24 |
| 6 | 0 | | | |
| 12 | 6.5 | 0 | | |
| 18 | 8.23 | 3.92 | 0 | |
| 24 | | 6.07 | 3.12 | 0 |
| 30 | | 7.35 | 4.88 | 2.68 |
| 36 | | | 6.16 | 4.27 |
| 42 | | | 7.17 | 5.32 |
| 48 | | | | 6.16 |
| | | Tension (lbs.) | | |

| Black Elastic Member | | | | |
|---|---|---|---|---|
| Stretched | Initial Length (in.) | | | |
| Length (in.) | 6 | 12 | 18 | 24 |
| 6 | 0 | | | |
| 12 | 5.94 | 0 | | |
| 18 | | 4.22 | 0 | |
| 24 | | 6.29 | 3.26 | 0 |
| 30 | | | 5.19 | 2.82 |
| 36 | | | 6.51 | 4.71 |
| 42 | | | 7.57 | 5.85 |
| 48 | | | | 6.91 |
| | | Tension (lbs.) | | |

It will be apparent to one skilled in the art that variations in the method of using the elastic members indicated in the above charts may also be employed without deviating from the present invention. For example, if a twenty-four inch length of the yellow color-coded elastic member material was formed in a loop, the loop, when grasped or secured at opposite sides, would effectively be two parallel, twelve-inch lengths of elastic member as shown in the chart. Thus, the tension in stretching such a loop (initially twelve inches) to a length of twenty-four inches would be twice that shown for a twelve-inch length in the chart, or 5.72 pounds.

Printing the Indicia

Printing tension-indicating indicia on elastic members involves selecting a member of the desired thickness and stretch-length for a particular tension as described above. The elastic member is placed on a printing apparatus and stretched to the desired length, and the desired pattern is printed onto the surface of the elastic member using ink, paint, or other marking media known in the art. The printing apparatus may be any type of printer, printing press, offset press, or other printing device known in the art. The operation of printing the image may be accomplished using any known printing method such as silk-screening, offset printing, ink-jet printing, laser printing, and the like. The printing operation may be done in a single pass, or various passes applying various colors or shades may be used. In the case of printing moiré patterns, the printing may be applied to the upper and lower surfaces of a transparent or translucent elastic member, or printing may be applied to a single surface, with the elastic member re-tensioned between printing of additional patterns. Other imaging methods known in the art for placing the patterns or images onto the elastic member, such as engraving or etching, may be used, and will be apparent to those skilled in the art.

In the case of printing elastic members in which a recognizable pattern is visible when the member is in its relaxed state, preferably the printing is achieved as described above, where the desired second pattern is printed on the surface of the elastic member when the elastic member is placed at the desired tension level. Alternatively, a first pattern may be printed on the elastic member in its relaxed state.

As described above, the printed indicia may comprise recognizable images or patterns that distort or change to different patterns when a predetermined tension level is attained in the elastic member. Preferably, the indicia appear as an unrecognizable image or pattern when the elastic member is in its relaxed state, but form a recognizable image or pattern when the elastic member attains a predetermined level of tension. Most preferably, the images or patterns are particular types, such as pointillist, halftone, or moiré patterns, which appear as an indeterminate image when the elastic member is in its relaxed state, and appear as a recognizable image or pattern when the elastic member attains a predetermined level of tension.

As can be seen, the invention described herein provides a method and apparatus for providing physical therapy exercise that allows the user to precisely and accurately determine when the predetermined level of tension in the elastic member has been attained. Thus, the user is assured of receiving the appropriate treatment or exercise, with no chance of under or over extending the muscles being targeted.

The term "substantially" or "approximately" as used herein may be applied to modify any quantitative representation which could permissibly vary without resulting in a change in the basic function to which it is related. For example, while the tension for a yellow color-coded elastic member having an initial length of six inches and stretched to twelve inches is described as having a tension of approximately 2.86 pounds, the actual tension at that length may permissibly vary from 2.86 pounds if the variance does not materially alter the capability of the invention.

While the present invention has been described and illustrated hereinabove with reference to various exemplary methods and embodiments, it should be understood that various modifications could be made to these methods and embodiments without departing from the scope of the invention. Therefore, the invention is not to be limited to the exemplary methods and embodiments described and illustrated hereinabove.

What is claimed and desired to be secured by Letters Patent is as follows:

1. An apparatus for use in exercising, rehabilitating or strengthening a user's body, comprising:

an elastic member;

a handle; and a tension indicator having a first side directly and rigidly attached to said handle and a second side attached to said elastic member, said tension indicator comprising an electronic indicator operable to provide a cue when said elastic member attains a predetermined tension.

2. The apparatus of claim 1, wherein said cue comprises an audible indicator.

3. The apparatus of claim 1, wherein said cue comprises a visual indicator.

4. The apparatus of claim 3, wherein said visual indicator comprises a light-emitting indicator.

5. The apparatus of claim 1, wherein said electronic indicator comprises a strain gauge.

6. An apparatus for use in exercising, rehabilitating or strengthening a user's body, comprising:

a handle; and a tension indicator having a first side directly and rigidly attached to said handle and a second side configured for attachment to an elastic member, said tension indicator comprising an electronic indicator operable to provide a cue when the elastic member attached to said tension indicator attains a predetermined tension.

7. The apparatus of claim 6, wherein said cue comprises an audible indicator.

8. The apparatus of claim 6, wherein said cue comprises a visual indicator.

9. The apparatus of claim 8, wherein said visual indicator comprises a light-emitting indicator.

10. The apparatus of claim 6, wherein said electronic indicator comprises a strain gauge.

11. The apparatus of claim 6, wherein said tension indicator is configured for attachment to a first end of the elastic member, and further comprising a second handle configured for attachment to a second end of the elastic member.

* * * * *